United States Patent [19]

Korischum

[11] 4,129,745

[45] Dec. 12, 1978

[54] LARGE INSULATOR WITH PARTICULAR CEMENTED JOINT

[75] Inventor: Fritz Korischum, Wettingen, Switzerland

[73] Assignee: Brown, Boveri & Company Limited, Baden, Switzerland

[21] Appl. No.: 774,117

[22] Filed: Mar. 3, 1977

[30] Foreign Application Priority Data

Mar. 12, 1976 [CH] Switzerland ..... 003081/76
Dec. 20, 1976 [CH] Switzerland ..... 015981/76

[51] Int. Cl.[2] ..... H01B 17/66
[52] U.S. Cl. ..... 174/209; 174/212
[58] Field of Search ..... 174/30, 141 R, 141 C, 174/150, 178, 179, 195, 209, 210, 211, 212

[56] References Cited

U.S. PATENT DOCUMENTS 2,292,248 8/1942 Stevens ..... 174/209

FOREIGN PATENT DOCUMENTS 508660 2/1952 Belgium ..... 174/209
1125372 7/1956 France ..... 174/209
97731 2/1923 Switzerland ..... 174/210
215496 10/1941 Switzerland ..... 174/209

*Primary Examiner*—Laramie E. Askin
*Attorney, Agent, or Firm*—Toren, McGeady and Stanger

[57] ABSTRACT

A large insulator is composed of several partial insulators. At least two such partial insulators are placed one above another. The upper partial insulator has a plane surface on the base portion of the insulator. An annular protective screen is also provided on the upper insulator having ridges and grooves on the underside thereof. The lower partial insulator has a plane surface on the upper portion. The two plane surfaces are cemented together to form a joint. The cemented joint is provided at the level of the base between the groove bottom of the innermost groove and the ridge top of the innermost ridge.

5 Claims, 1 Drawing Figure

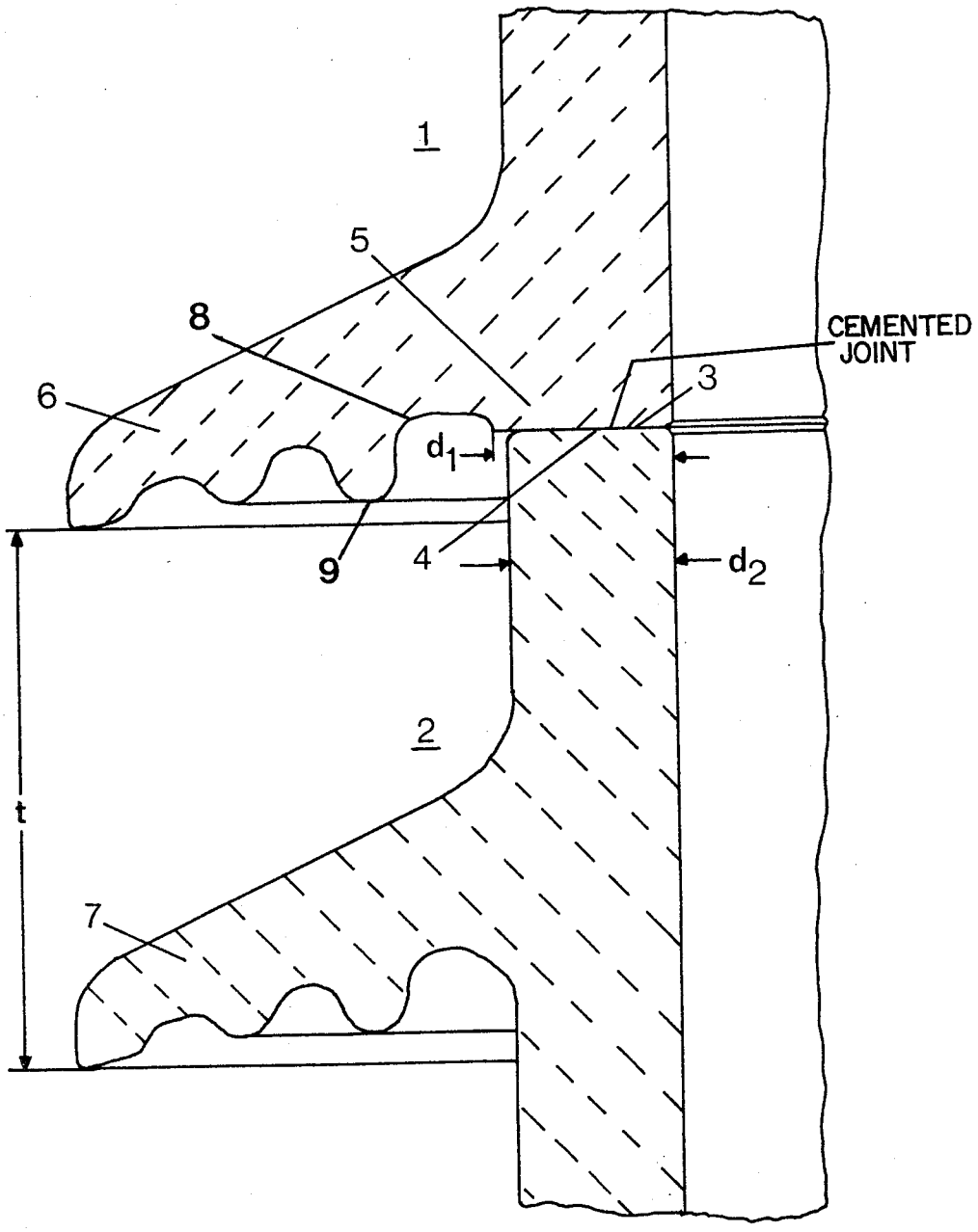
1
5
8
CEMENTED JOINT
3
6
$d_1$
9
4
$d_2$
2
t
7

LARGE INSULATOR WITH PARTICULAR CEMENTED JOINT

FIELD OF THE INVENTION

The invention relates to a large insulator consisting of at least two ceramic partial insulators each provided with at least one annular protective screen and having cemented plane surfaces.

BACKGROUND OF THE PRESENT INVENTION

The constantly increasing voltages in electrical transmission networks require greater sparkover widths between the live power supply and apparatus parts and the earth. This requires great insulator lengths. If active parts of the apparatus must be housed inside the insulator, the diameters of the insulators are also large. Against the influences of the atmosphere and other environmental influences, which reduce the insulating strength, projecting annular protective screens must be provided for the above mentioned high voltage in order to increase the creepage path. In general, these large insulators represent rather complicated structures.

The production of large insulators requires considerable engineering effort which manifests itself in high costs. Depending on the insulating material and the technology used, large construction gages, molds, baking and hardening furnaces as well are required. With increasing insulator size, the waste and shipping risk similarly increase.

There has been no lack of attempts in the past to optimize the manufacture of insulators both technically and economically. It has been known for a long time how to make large insulators from several burnt partial insulators. Clips are used as connecting means which are arranged as press elements inside the insulator. Recently, cementing has been added as a new technique. Thus, a large insulator cemented from several partial insulators is known from the German publication "STEMAG Nachrichten" no. 40 of April 1967, particularly p. 1076. The form of the adhesion surfaces, however, particularly of the plane surfaces, did not meet the requirements of simple manufacture, strength of joint, protection against environmental influences and esthetic design, which these surfaces and the finished insulator must have.

SUMMARY OF THE PRESENT INVENTION

An object of the present invention is therefore the provision of a large insulator which can be produced in a simple and economical manner and which is characterized by a high degree of safety and long service life.

In accordance with the present invention, a large insulator comprises at least two ceramic partial insulators, each provided with at least one annular protective screen. One of the partial insulators has a plane surface at a lower end thereof and another partial insulator has a plane surface at an upper end thereof. The two partial insulators are arranged one above the other and said plane surfaces are cemented together to form a cemented joint. The annular protective screen of the upper partial insulator has a base portion and a series of concentric ridges and grooves on the underside of the annular protective screen. The cemented joint is arranged at the level of the base portion between the level of the bottom of the innermost groove and the level of the top of the innermost ridge.

For a better understanding of the present invention, reference is made to the accompanying drawing and following description, while the scope of the invention is being pointed out in the appended claims.

BRIEF DESCRIPTION OF THE DRAWING

The sole drawing illustrates in partial sectional view an insulator in accordance with the present invention.

DETAILED DESCRIPTION OF THE INVENTION

In the drawing, 1 denotes an upper, 2 a lower partial insulator. These may consist of ceramic or synthetic materials, for example, casting resin. Both partial insulators have plane tooled end faces 3,4 extending perpendicular to their center axes. The end faces 3,4 form surfaces for adhesion by employing a cement to form a cemented joint therebetween. The tooled surface 3 of the upper partial insulator 1 is arranged inside the partial rounding of base 5 of annular protective screen 6 below groove bottom 8 of the innermost groove and above the ridge top 9 of the innermost ridge. The radial width of the tooled ring surface of the upper partial insulator 1 is designated by $d_1$, the wall thickness of the hollow cylindrical part above annular protective screen 7 of the lower partial insulator 2 by $d_2$. The radial width $d_1$ is greater than the thickness $d_2$; preferably $d_1$ is $1.25 \times d_2$. The cemented joint is preferably produced with epoxy resin.

In tooling the end face 4 of the lower partial insulator 2, it is necessary to observe the distance, t, between annular protective screens. This can readily be accomplished in view of the abundantly available extra material on the cylindrical part of the partial insulator above its annular protective screen 7.

Accordingly, large insulators of the above described type are composed of several partial insulators. The cemented joint between two successive partial insulators is provided at the level of the base of the underside of the annular protective screen below the groove bottom of the innermost groove and above the ridge top of the innermost ridge of a partial insulator, preferably 2–4 mm below the groove bottom of the innermost groove. Due to the arrangement of the adhesion surfaces, the cemented joint is optimally protected against atmospheric influences and deposits caused by environment pollution. The manufacture, particularly the tooling of the latter adhesion surfaces, is substantially simplified, since only plane surfaces have to be tooled on both partial insulators. Consequently, a high-grade "fine-joint" is formed.

By utilizing the material existing in the rounding of the base of the annular protective screen, one obtains a larger working surface which enables deviations from the nominal form of the partial insulator to be overcome. In this manner, a maximum adhesion surface is always available. Beyond that, the cemented joint is strengthened by the directly adjoining annular protective screen. Differences in the form and in the diameter between the individual partial insulators are practically unnoticeable, so that a large insulator of this type is also satisfactory in esthetic respect.

Due to the design and arrangement of the adhesion surfaces, the entire insulator can be straightened out in an insulator with distorted non-straight center lines. This is not possible or can be performed only to a minor extent in other designs and arrangements using a cemented joint.

As described above, the adhesion surfaces are preferably so tooled that they are perpendicular to the center axis of the insulator. Furthermore, practice has shown that it suffices to make the tooled surface on the underside of the upper partial insulator approximately 25% larger than the end face of the lower partial insulator or the radial width of the tooled surface of the upper partial insulator larger by a quarter of the wall thickness of the lower partial insulator. This ensures that the full maximum adhesion surface provided by the end face of the lower partial insulator is available. In order to maintain a uniform division of the annular protective screens, that is, the measure between two successive annular protective screens, the upper end of the respective lower partial insulator is correspondingly tooled.

A synthetic resin cement may be used which hardens at low temperatures. A cold-hardening, particularly solvent-free resin, such as an epoxy resin, may also be used. Accordingly, heat treatment of the assembled parts is not necessary. The evenness of the surfaces to be cemented with each other is relatively simple to achieve. This permits the use of thin flowing cements, thus easier to handle cements, which increases the strength of the cemented joint.

While the above description has been presented with respect to the preferred embodiments thereof, it will be obvious to those skilled in the art that various changes and modifications may be made therein without departing from the true spirit and scope of the present invention. What is claimed is:

1. A large insulator comprising:

at least two ceramic partial insulators, each provided with at least one annular protective screen, one of the partial insulators having a center axis and having a plane face at a lower end thereof, another partial insulator having a center axis and having a plane face at an upper end thereof, said two partial insulators being arranged one above the other with said plane faces being cemented together to form a cemented joint, the lower end face of the upper partial insulator extending perpendicularly relative to the center axis of the upper partial insulator, the upper end face of the lower partial insulator extending perpendicularly relative to the center axis of the lower partial insulator, the plane lower end face of the upper partial insulator being larger than the plane upper end face of the lower partial insulator so that the entire plane end face of the lower partial insulator is cemented to the lower plane end face of the upper partial insulator, said annular protective screen of the upper partial insulator having a base portion and a series of concentric ridges and grooves on the underside of the annular protective screen, said cemented joint being arranged at the level of said base portion between the level of the bottom of the innermost groove and the level of the top of the innermost ridge.

2. A large insulator in accordance with claim 1 wherein said cemented joint is arranged 2–4 mm below the bottom level of the innermost groove.

3. A large insulator in accordance with claim 1 wherein said plane face of the upper partial insulator is approximately 25% larger than the plane face of the lower partial insulator.

4. A large insulator in accordance with claim 1 wherein the upper end of the lower partial insulator has a certain wall thickness, and wherein the radial width of the plane face of the upper partial insulator is larger than the wall thickness of the lower partial insulator.

5. A large insulator in accordance with claim 4 wherein the radial width of the plane face of the upper partial insulator is 25% larger than the wall thickness of the lower partial insulator.

* * * * *